United States Patent [19]

Johnson

[11] Patent Number: 5,055,986

[45] Date of Patent: Oct. 8, 1991

[54] COMBINATION LIGHT, RADIO AND CLOCK

[76] Inventor: Mary B. Johnson, 813 Roselawn, Shreveport, La. 71106

[21] Appl. No.: 600,676

[22] Filed: Oct. 22, 1990

[51] Int. Cl.[5] ..... F21V 33/00

[52] U.S. Cl. ..... 362/253; 362/183; 455/344

[58] Field of Search ..... 362/86, 183, 234, 253; 368/10; 455/344, 351

[56] References Cited

U.S. PATENT DOCUMENTS

| | | | |
|---|---|---|---|
| 3,368,067 | 2/1968 | Paxinos | 455/344 X |
| 4,045,663 | 8/1977 | Young | 455/344 X |
| 4,631,649 | 12/1986 | McCue et al. | 362/191 X |
| 4,676,619 | 6/1987 | Wooley | 362/253 X |
| 4,682,147 | 7/1987 | Bowman | 340/286 R |
| 4,686,424 | 8/1987 | Nuckolls et al. | 315/86 |
| 4,789,922 | 12/1988 | Cheshire | 362/158 |
| 4,799,039 | 1/1989 | Balcom et al. | 340/333 |
| 4,949,077 | 8/1990 | Mbuthia | 362/253 X |

*Primary Examiner*—Stephen F. Husar
*Attorney, Agent, or Firm*—John M. Harrison

[57] ABSTRACT

A combination light, radio and clock which is designed for operation on two types of batteries, one of which is supplied by conventional alternating current. The device includes a cabinet or housing designed for mounting on a wall or resting on a flat surface, with an incandescent light, a radio and a clock mounted therein. The light, clock and radio may be utilized during normal operating periods by conventional alternating current which is converted to direct current by a transformer and during emergencies by a rechargeable battery, as well as one or more replaceable, rechargeable or non-rechargeable batteries.

18 Claims, 1 Drawing Sheet

FIG. 1
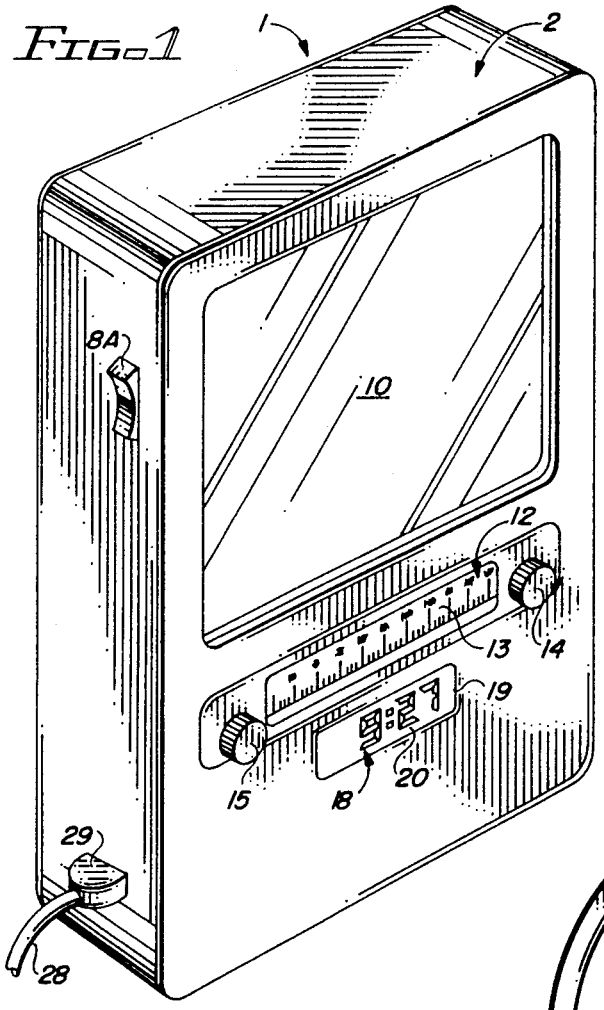
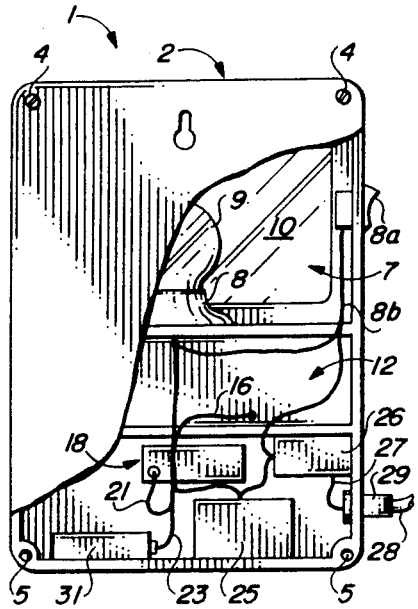
FIG. 2
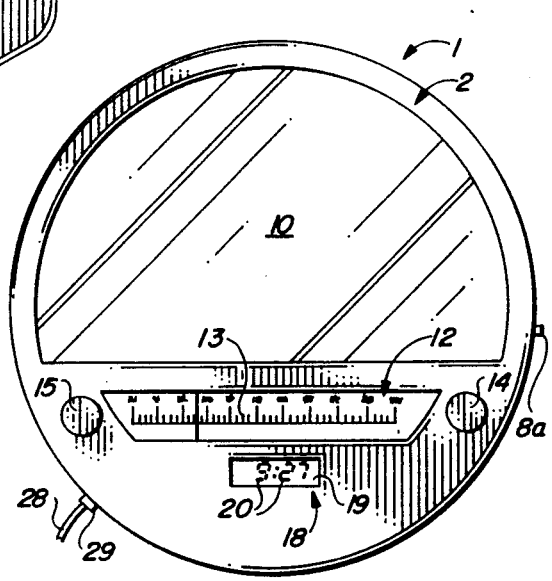
FIG. 3
FIG. 4
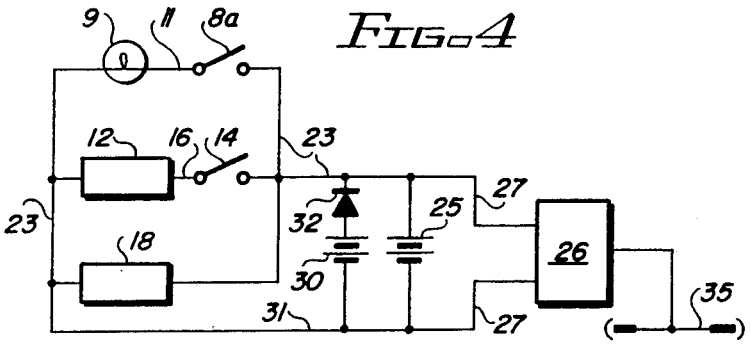

COMBINATION LIGHT, RADIO AND CLOCK

BACKGROUND OF THE INVENTION

1. Field of the Invention

This invention relates to an emergency communication devices and more particularly, to a combination light, radio and clock which is designed for operation under non-emergency, as well as emergency conditions. In a preferred embodiment the combination light, radio and clock is characterized by a cabinet or housing designed for mounting on the wall or resting on a flat surface and containing an incandescent light, a radio and a digital clock, each powered by a rechargeable battery connected to a transformer coupled to a source of alternating current. An alternative back-up battery system is also provided, wherein the battery or batteries may be rechargeable or non-rechargeable, as desired. Accordingly, the combination light, radio and clock may be utilized under circumstances of emergency where household current has been disrupted and may not be available for long periods of time. The combination light, radio and clock is portable and may be used as a flashlight, radio and clock in both permanent and portable mode, as desired.

One of the problems which exists during power outages is that of corresponding disruption of communication, lack of visibility in darkened structures or areas and disorientation as to the time of day or night. These circumstances may occur to a lesser extent during relatively minor power disruptions such as thunderstorms, transformer or other service equipment malfunctions and the like, or in more serious power outages during hurricanes, tornadoes, war and similar circumstances.

2. Description of the Prior Art

Portable radios, flashlights and similar lights, as well as small, portable clocks are well known in the art. Similar devices include the "Plug-In Emergency Light Fixture" detailed in U.S. Pat. No. 4,631,649, dated Dec. 23, 1986, to Robert J. McCue, et al. The McCue emergency light fixture is permanently mounted in a conventional power outlet box having a threaded bore for accommodating a screw to mount a face plate, and slots for accommodating an electric plug. The emergency light fixture includes a housing, an electric plug extending from the rear wall of the housing, a battery, a battery charger and a lamp mounted in the housing and wired to provide illumination during power outages. U.S. Pat. No. 4,682,147, dated July 21, 1987, to Norman E. Bowman, details an "Emergency Sign". The patent describes an illuminated exit sign having multiple, series-connected, light-emitting diodes arranged to form the word "EXIT" and a control circuit for supplying power to the series-connected diodes from the line power and, during power failures, from battery power. The control circuit illuminates the diodes continuously during normal operation and switches the diodes alternately on and off during a power failure. U.S. Pat. No. 4,686,424, dated Aug. 11, 1987, to Joe A. Nuckolls, et al, details "Emergency Lighting Circuits". The emergency lighting circuit includes a lamp which can be energized by a battery-inverter circuit upon power failure. The battery is connected to the inverter circuit and the lamp by a relay which is connected to the rectifier supplying charging current to the battery. The rectifier is connected across the power supply line in series with a ballast reactor. The circuit can be used as emergency lighting only, or the lamp may be employed for normal lighting purposes and switched to the inverter power when line voltage is interrupted. An "Earthquake Safety Light" is detailed in U.S. Pat. No. 4,789,922, dated Dec. 6, 1988, to Thomas Cheshire. The specially designed light is suitable for mounting on the wall of a building or room and contains an apparatus which includes a weighted object which will be displaced upon occurrence of an earthquake having a preset magnitude. Upon being displaced, the object will close a circuit and activate an emergency light to enable relocation from the earthquake zone. The light is battery-activated and may be of the type which is continually charged by normal household current and may include a low drain test light to indicate battery condition. U.S. Pat. No. 4,799,039, dated Jan. 17, 1989, to James E. Balcom, et al, details an "Emergency Lighting Supervisory System". The system monitors utility power, in order to automatically connect emergency lights to a battery source when the utility power fails. The system continually monitors selected parameters, automatically periodically tests the system under simulated, full-load conditions and enunciates the results of these tests.

It is an object of this invention to provide a combination light, radio and clock which may be utilized to full advantage in both emergency and non-emergency conditions.

Another object of this invention is to provide a combination light, radio and clock which includes a cabinet or housing adapted for mounting on a wall or resting on a flat surface and including the light, radio and clock and an electric circuit operated by one or more batteries.

A still further object of this invention is to provide a combination light, radio and clock which is characterized by a housing suitable for mounting on the wall or resting on a flat surface and including an incandescent light, a radio and a digital clock primarily operated by a rechargeable battery connected to a transformer fed by a source of alternating current and alternatively operated by a back-up, non-rechargeable or rechargeable battery.

SUMMARY OF THE INVENTION

These and other objects of the invention are provided in a combination light, radio and clock mounted in a housing adapted for mounting on the wall or resting on a flat surface and including an incandescent light provided with a light switch for selective activation thereof, a radio having a radio switch for operation thereof and a clock which operates continuously, which light, radio and clock are powered by a primary, rechargeable battery system connected to a transformer supplied by alternating current and a diode, which diode operates to enable a back-up battery when the primary battery discharges.

BRIEF DESCRIPTION OF THE DRAWING

The invention will be better understood by reference to the accompanying drawing, wherein:

FIG. 1 is a perspective view of a preferred embodiment of the combination light, radio and clock of this invention;

FIG. 2 is a rear view, partially in section, of the combination light, radio and clock illustrated in FIG. 1;

FIG. 3 is a front elevation of an alternative preferred embodiment of the combination light, radio and clock of this invention; and FIG. 4 is a schematic circuit diagram of a preferred electrical circuit for operating the combination light, radio and clock illustrated in FIGS. 1–3.

DESCRIPTION OF THE PREFERRED EMBODIMENTS

Referring initially to FIGS. 1, 2 and 4 of the drawing, in a preferred embodiment the combination light, radio and clock of this invention is generally illustrated by reference numeral 1. The combination light, radio and clock 1 includes a housing 2, fitted with a removable back panel 3, which is attached to the housing 2 by means of fasteners 4 such as screws, which are threadably seated in fastener apertures 5, located in the housing 2. A key slot 6 is provided in the back panel 3 for engaging a nail, screw or other fastener (not illustrated) mounted in a wall (not illustrated) or in turn, mounting the combination light, radio and clock 1 on a flat surface. A light chamber 7 is provided in the upper portion of the housing 2 for receiving a light base 8 that threadably mounts an incandescent light bulb 9. Alternatively, the light base 8 may be characterized by a slotted fitting which receives projecting rods or bars (not illustrated), mounted on the light bulb for removably seating the light bulb in the light base 8, according to the knowledge of those skilled in the art. A light switch 8*a* is mounted in the side of the cabinet 2 and is attached by means of light switch wiring 8*b* to the light bulb wiring 11, which extends between the light base 8 and the wiring harness 23, for controlling illumination of the light bulb 9, as hereinafter further described. A transparent lens 10 is fitted over the front of the cabinet 2 to close the front of the light chamber 7 and beam light from the light bulb 9, and facilitate use of the combination light, radio and clock either as a portable flashlight or as a fixed source of illumination in a room or other area, as desired. A radio 12 is mounted in the housing 2 beneath light chamber 7 and includes a station indicator 13 provided in the front panel of the cabinet 2, a power and volume control knob 14 and a station selector knob 15. Radio wiring 16 is also provided in the radio 12 and connects to the wiring harness 23, in order to supply power to the radio 12, as further hereinafter described. A clock 18 is located in the housing 2 beneath the radio 12 and includes a display window 19 located in the front panel of the cabinet 2 and a conventional clock mechanism (not illustrated) for displaying the numerals 20 in sequence and indicating the current time of day or night in the display window 19. Clock wiring 21 is connected to the clock mechanism and the wiring harness 23 for supplying power, as further hereinafter described.

Referring now to FIGS. 2 and 4 of the drawings, a power cord 28 extends from a power source 35, illustrated in FIG. 4, to the housing 2, where a power cord plug connects the power cord 28 to a transformer 26, which rectifies alternating current from the power source 35 to direct current. The direct current is directed to a rechargeable battery 25 and the rechargeable battery 25 may typically be constructed of nickel-cadmium or other materials well known to those skilled in the art, and is designed to supply power to the wiring harness 23. Accordingly, it will be appreciated from a consideration of the circuit diagram in FIG. 4 that alternating current power is supplied from the power source 35 through the power cord 28 to the transformer 26, where it is rectified and filtered into direct current. The direct current is caused to flow through the transformer wiring 27 into the rechargeable battery 25. The current from the rechargeable battery 25, in turn, continues to flow through the transformer wiring 27 to the wiring harness 23, and to the clock 18, in order to continuously operate the clock 18 and selectively, to the light bulb 9 and the radio 12, through the light switch 8*a* and the power and volume control knob 14, respectively. Operation of the radio 12 and illumination of the light bulb 9 thus depends upon manipulation of the power and volume control knob 14 in the radio 12 and the light switch 8*a*, which causes current to flow through the radio wiring 16 and light switch wiring 8*b*, respectively. As further illustrated in FIG. 4, in a preferred embodiment of the invention a diode 32 is connected to the rechargeable battery 25 and to a back-up battery 30 by means of the transformer wiring 27. A back-up battery circuit 31 is connected to the transformer wiring 27 for causing current to flow from the back-up battery 30 through the diode 32, to the wiring harness 23, if the rechargeable battery 25 should discharge.

Referring now to FIG. 3 of the drawing, it will be appreciated by those skilled in the art that the combination light, radio and clock 1 may be characterized by a round housing 2, which is also provided with a housing back 3 and a key slot 6 for mounting the cabinet 2 on a wall of the structure, as illustrated in FIG. 2. Like the cabinet 2 illustrated in FIG. 1, the round cabinet 2 illustrated in FIG. 3 includes a lens 10 for enclosing a light bulb 9, as illustrated in FIG. 2. Furthermore, a radio 12 is located beneath the lens 10 and a clock 18 is positioned beneath the radio 12. Moreover, the wiring for the combination light, radio and clock 1 illustrated in FIG. 3 may be identical to that illustrated in FIGS. 2 and 4.

It will be appreciated from a consideration of the combination light, radio and clock 1 illustrated in FIGS. 1–4 that many variations are possible in the wiring and operation of the device. For example, the light bulb 9 may be characterized by a light-emitting diode, according to the knowledge of those skilled in the art. Furthermore, various alternative wiring combinations may be utilized in order to effect additional desired operational modes of the light bulb 9, radio 12 and clock 18. Accordingly, while the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A combination light, radio and clock comprising a housing; at least one battery provided in said housing; transformer means provided in said housing, said transformer means connected to said battery and to a source of alternating current for converting said alternating current to direct current delivered to said battery; an electric circuit provided in said housing, said electric circuit connected to said battery and adapted to carry the direct current; and a light, a radio and a clock provided in said housing, said light, said radio and said clock connected to said electric circuit for receiving the direct current and energizing said light, said radio and said clock.

2. The combination light, radio and clock of claim 1 wherein said at least one battery further comprises at least one rechargeable battery.

3. The combination light, radio and clock of claim 2 wherein said at least one rechargeable battery further comprises a single rechargeable battery and a non-rechargeable battery and further comprising relay means provided in said electric circuit and connected to said rechargeable battery and said non-rechargeable battery, whereby said non-rechargeable battery supplies direct current to said light, said radio and said clock responsive to low voltage in said rechargeable battery and operation of said relay means.

4. The combination light, radio and clock of claim 1 further comprising a light switch provided in said electric circuit and connected to said light for selectively energizing said light.

5. The combination light, radio and clock of claim 4 wherein said at least one battery further comprises at least on rechargeable battery.

6. The combination light, radio and clock of claim 5 wherein said at least one rechargeable battery further comprises a single rechargeable battery and a non-rechargeable battery and further comprising relay means provided in said electric circuit and connected to said rechargeable battery and said non-rechargeable battery, whereby said non-rechargeable battery supplies direct current to said light, said radio and said clock responsive to low voltage in said rechargeable battery and operation of said relay means.

7. The combination light, radio and clock of claim 1 wherein said housing is generally rectangular.

8. The combination of claim 1 wherein said housing is cylindrical.

9. A combination light, radio and clock comprising a housing, an electric circuit provided in said housing; at least one rechargeable battery provided in said housing and connected to said electric circuit; a transformer provided in said housing, said transformer connected to said battery and said electric circuit and adapted to receive alternating current and convert the alternating current to direct current for continuously charging said rechargeable battery; a light, a radio and a clock provided in said housing, said light, said clock and said radio connected to said electric circuit for receiving the direct current and energizing said light, said clock and said radio.

10. The combination light, radio and clock of claim 9 wherein said at least one rechargeable battery further comprises a single rechargeable battery and a non-rechargeable battery and further comprising relay means provided in said electric circuit and connected to said rechargeable battery and said non-rechargeable battery, whereby said non-rechargeable battery supplies direct current to said light, said radio and said clock responsive to low voltage in said rechargeable battery and operation of said relay means.

11. The combination light, radio and clock of claim 9 further comprising a light switch provided in said electric circuit and connected to said light for selectively energizing said light.

12. The combination light, radio and clock of claim 11 wherein said at least one rechargeable battery further comprises a single rechargeable battery and a non-rechargeable battery and further comprising relay means provided in said electric circuit and connected to said rechargeable battery and said non-rechargeable battery, whereby said non-rechargeable battery supplies direct current to said light, said radio and said clock responsive to low voltage in said rechargeable battery and operation of said relay means.

13. The combination light, radio and clock of claim 9 wherein said housing is rectangular.

14. The combination light, radio and clock of claim 9 wherein said housing is cylindrical.

15. A combination light, radio and clock comprising a housing, an electric circuit provided in said housing; at least one rechargeable battery provided in said housing and connected to said electric circuit; a transformer provided in said housing, said transformer connected to said battery and said electric circuit and adapted to receive alternating current and convert the alternating current to direct current for continuously charging said rechargeable battery; a light, switch means connected to said light and said electric circuit, a radio and a clock provided in said housing, said clock and said radio also connected to said electric circuit for receiving the direct current and selectively energizing said light, said clock and said radio.

16. The combination light, radio and clock of claim 15 wherein said at least one rechargeable battery further comprises a single rechargeable battery and a non-rechargeable battery and further comprising relay means provided in said electric circuit and connected to said rechargeable battery and said non-rechargeable battery, whereby said non-rechargeable battery supplies direct current to said light, said radio and said clock responsive to low voltage in said rechargeable battery and operation of said relay means.

17. The combination light, radio and clock of claim 15 wherein said housing is generally rectangular.

18. The combination light, radio and clock of claim 15 wherein said housing is cylindrical.

* * * * *